US005225872A

United States Patent [19]

Fukushima

[11] Patent Number: 5,225,872

[45] Date of Patent: Jul. 6, 1993

[54] IMAGE FORMING APPARATUS HAVING DEVICE FOR DETERMINING MOISTURE ABSORPTION

[75] Inventor: Hisashi Fukushima, Yokohama, Japan

[73] Assignee: Canon Kabushiki Kaisha, Tokyo, Japan

[21] Appl. No.: 367,681

[22] Filed: Jun. 19, 1989

[30] Foreign Application Priority Data

Jun. 21, 1988 [JP] Japan ..... 63-151208

[51] Int. Cl.[5] ..... G03G 15/04

[52] U.S. Cl. ..... 355/208; 355/214; 355/215; 355/246

[58] Field of Search ..... 355/208, 245, 246, 214, 355/215, 326, 327, 30; 118/653, 656, 657, 658

[56] References Cited

U.S. PATENT DOCUMENTS

| | | | |
|---|---|---|---|
| 3,814,516 | 6/1974 | Whited | 355/246 |
| 4,134,147 | 1/1979 | Watanabe | 355/272 X |
| 4,314,755 | 2/1982 | Kinashi | 355/208 X |
| 4,521,103 | 6/1985 | Ohtsuka et al. | 355/208 X. |
| 4,610,530 | 9/1986 | Lehmbeck et al. | 355/309 X |
| 4,676,627 | 6/1987 | Ohno | 355/326 X |
| 4,888,618 | 12/1989 | Ishikawa | 355/208 |
| 4,912,515 | 3/1990 | Amemiya et al. | 355/326 X |
| 5,029,314 | 7/1991 | Katsumi et al. | 355/208 |

*Primary Examiner*—Joan H. Pendegrass
*Assistant Examiner*—Robert Beatty
*Attorney, Agent, or Firm*—Fitzpatrick, Cella, Harper & Scinto

[57] ABSTRACT

An image forming apparatus includes an image bearing member; an image forming device for forming a latent image on the image bearing member, the image forming device including a developing device for developing with a developer the latent image formed on the image bearing member; a detecting device for detecting an ambient condition at predetermined intervals; a device for determining the state of current moisture absorption of the developer on the basis of a current ambient condition at a current time, past state of moisture absorption of the developer at the predetermined period of time before the current time and an ambient condition determined on the basis of the past state of moisture absorption and a control device for controlling the image forming device in accordance with the current state of moisture absorption of the developer determined by the determining device.

33 Claims, 6 Drawing Sheets

IMAGE FORMING APPARATUS HAVING DEVICE FOR DETERMINING MOISTURE ABSORPTION

FIELD OF THE INVENTION AND RELATED ART

The present invention relates to an image forming apparatus of an electrophotographic type such as a copying machine and a laser beam printer, more particularly to an image forming apparatus wherein an imaging condition is controlled on the basis of moisture absorption of a developer.

In a conventional image forming apparatus using an electrophotographic process, the density of the formed image is maintained constant by controlling an image forming condition such as a charged potential of a photosensitive drum and a developing bias voltage applied to a developing device to control a contrast voltage of the developed image and a fog preventing voltage or the like. Particularly in a multi-color copying apparatus, as disclosed in U.S. Ser. No. 330,551, now U.S. Pat. No. 4,736,223, an image forming condition is selected in accordance with the properties of the developers having different colors so as to provide substantially the same image density for each of the colors.

Although the control of the image forming condition for the respective colors of the developers is performed in the conventional apparatus, the change in the image density in accordance with the change in the ambient condition where the developer is placed is not considered. Particularly the change of the image density due to the change in the humidity is significant, and in addition, the degrees of the density changes of different color developers resulting from the moisture absorption are different, so that the density difference is particularly remarkable.

U.S. Ser. No. 145,600, now U.S. Pat. No. 4,888,618, discloses that a moisture sensor for measuring the change in the ambient condition adjacent the developing device (absolute humidity) is provided to control an image forming condition by a control means in accordance with the detection in a predetermined period of time by the sensor and in accordance with the individual developer.

In this system, however, the data of the ambient condition which requires a long time to collect is necessary. Even for the same developer, the property of the developer is sometimes not suitable for the image forming condition obtained from the ambience detecting means, when, for example, the ambient condition suddenly changes. On such an occasion, the proper image density can not be provided.

SUMMARY OF THE INVENTION

Accordingly, it is a principal object of the present invention to provide an image forming apparatus wherein even when the ambient condition changes, the moisture absorption of the developer is properly predicted determined to provide a good image density.

It is another object of the present invention to provide an image forming apparatus which is operated on the basis of the previously stored data to provide a good image density.

It is a further object of the present invention to provide an image forming apparatus wherein images having good image density can be provided in an usual image formation when the ambient condition is suddenly changed, which change results in the change of the developer property.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
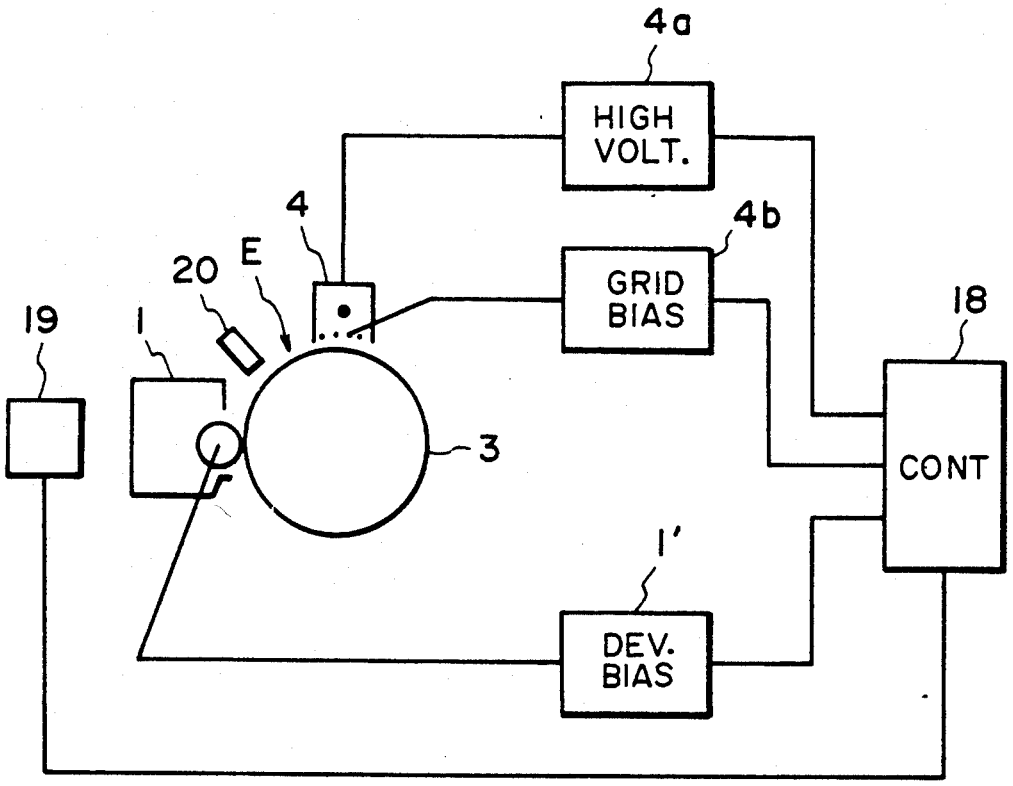
FIG. 1 is a block diagram of an image forming apparatus according to an embodiment of the present invention.
Figure 2:
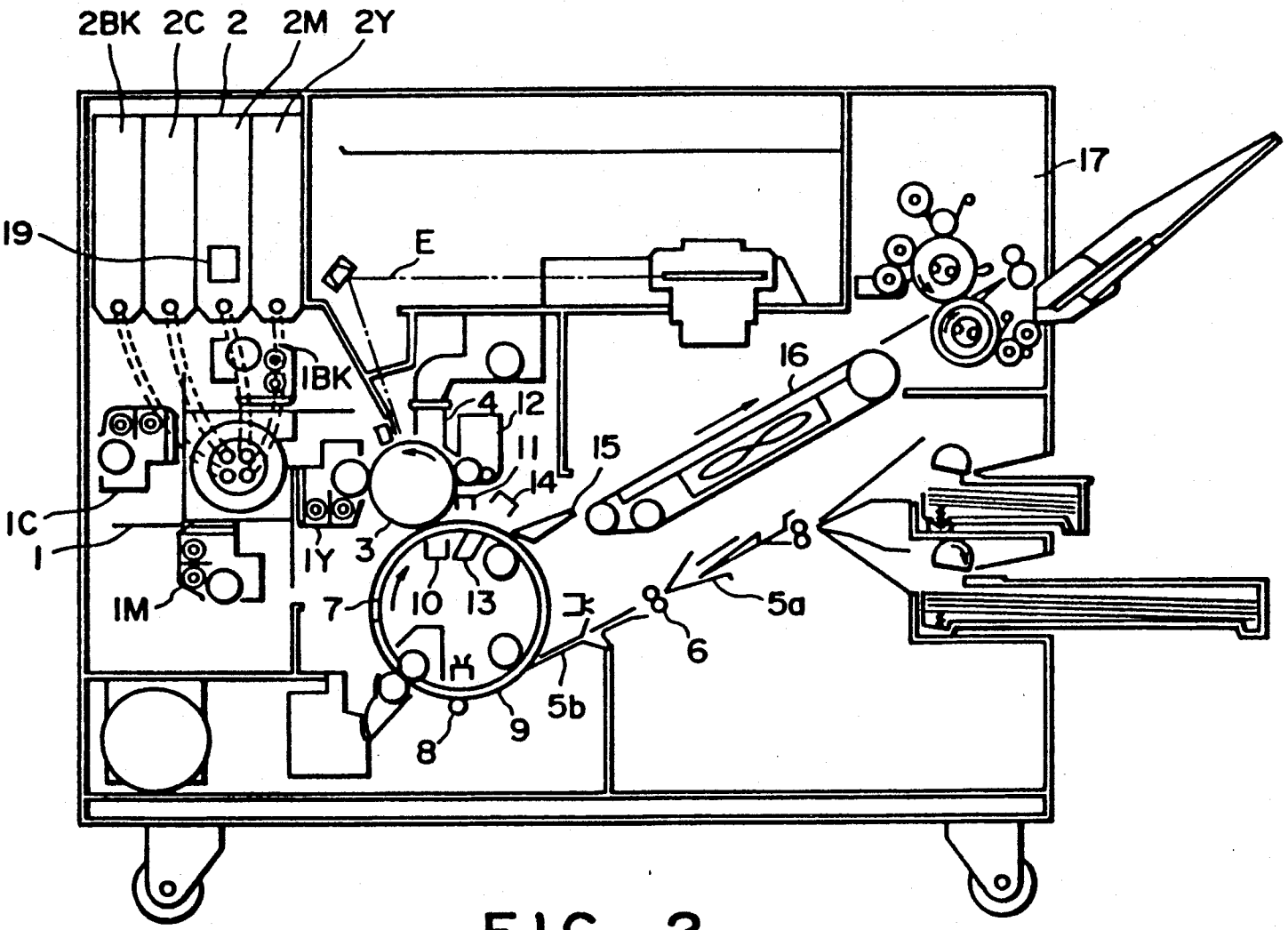
FIG. 2 is a cross sectional view of an image forming apparatus usable with the present invention.

Referring to FIGS. 1 and 2, there is shown an image forming apparatus according to an embodiment of the present invention. In FIG. 2, the image forming apparatus comprises a rotary type developing device 1 which carries an yellow developing device 1Y, a magenta developing device 1M, a cyan developing device 1C and a black developing device 1BK. A developer (toner) supplying device supplies the developer to the developing device 1 and includes a yellow hopper 2Y, a magenta hopper 2M, a cyan hopper 2C and a black hopper 2BK.

The operation of the color image forming apparatus will generally be described, taking an example of a full-color mode. A photosensitive drum 3 rotating in a direction indicated by an arrow is uniformly charged by a charger 4 and is exposed to image light by being exposed to a laser beam E modulated in accordance with a yellow image signal obtained from an unshown original, so that an electrostatic latent image is formed on the photosensitive drum 3. The electrostatic latent image is developed by the yellow developing device 1Y which has been set at the developing position by this time. An unshown microswitch discriminates which developing device is set at the developing position.

A transfer sheet is fed through a sheet guide **5*a*, a feeding roller 6 and a sheet guide 5*b* to a gripper 7 and is gripped thereby at a predetermined timing. The sheet is electrostatically attracted by attraction charger 8 and wound on the transfer drum 9 by a contact roller and an opposing electrode. The transfer drum 9 is rotated in the direction indicated by an arrow in synchronism with the photosensitive drum 3. The visualized image provided by the yellow developing device 1Y is transferred onto the transfer sheet by the transfer charger 10 at the image transfer station. The transfer drum 9** continues to rotate while carrying the transfer sheet and is ready for the image transfer for the next color (magenta in FIG. 1).

On the other hand, the photosensitive drum 3 is discharged by a discharger 11 and is cleaned by a cleaning device 12. Then, it is charged again by the charger 4 and is exposed to the image light in accordance with a magenta image signal. Before this time, the developing device 1 rotates to set at the developing position the magenta developing device 1M. The latent image is developed by the magenta developing device 1M. The above-described process steps are repeated to the cyan and black colors. When the images of four colors are transferred, the four visualized images on the transfer sheet is discharged by dischargers 13 and 14, and the transfer sheet is released from the gripper 7 and is separated from the transfer drum 9 by a separation pawl 15. The transfer sheet is conveyed by a conveying belt 16 to an image fixing device 17 where the image is fixed. Thus, a series of full-color printing operations are completed, and a full-color print is produced.

In this embodiment, an ambience sensor 19 is disposed within the apparatus, preferably adjacent to a toner hopper or at a position where the moisture absorption of the toner is properly reflected, for example, adjacent to the developing device. The ambience sensor 19 is constituted by a humidity sensor and a temperature sensor.

Referring now to FIG. 1, the apparatus according to this embodiment further comprises a high voltage power source 4a for supplying power to the primary charger (such as charger 4 shown in FIG. 2), a grid bias power source 4b for supplying power to a grid which is provided in the primary charger and is effective to control the amount of charge on the drum 3, a power source for supplying a developing bias to the developing device, the developing bias 1' comprising an AC component and a DC component, and control means 18 such as a a microcomputer for controlling outputs of the power sources. The control means 18 is connected with an ambience sensor 19 and a potential sensor 20.

Figure 3:
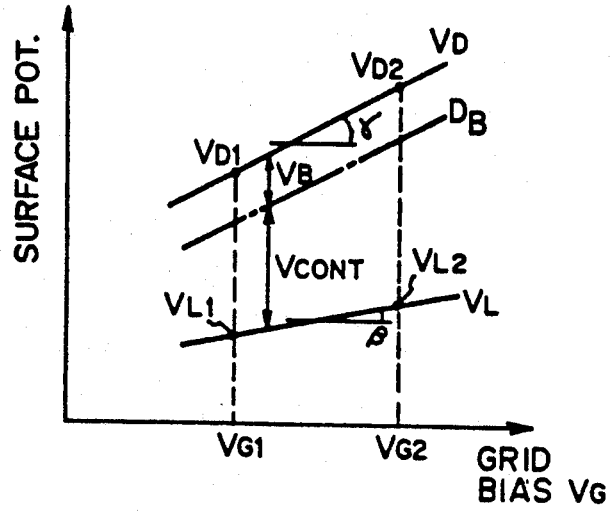
FIG. 3 is a graph of a drum surface potential vs. a grid bias voltage.

The operation will be described. FIG. 3 shows a relation between a surface potential of the photosensitive drum 3 and a grid bias voltage, wherein $V_D$ represents the surface potential where the drum is not exposed to light, and $V_L$ represents a surface potential where the drum is exposed to light. As will be understood from this figure, the surface potential $V_D$, that is, the amount of charge is proportional to the grid bias $V_G$ within a certain range. The surface potential $V_L$ of the exposed portion has the same tendency, but the rate of the change thereof relative to the change of the grid bias $V_G$, namely, a proportional coefficient, is larger for the surface potential $V_D$ than for the surface potential $V_L$ ($\alpha > \beta$). Before the printing sequential operation is performed, the control means 18 operates the apparatus to obtain the surface potentials $V_D$ and $V_L$ by the potential sensor 20 for predetermined grid voltages $V_{G1}$ and $V_{G2}$, so that the control means 18 determines charging curves as shown in FIG. 3, from the data, by which the charging curves represents the surface potentials $V_D$ and $V_L$ relative to the change of the grid voltage. When the actual image forming operation is performed thereafter, the control means calculates, from the charging curve obtained in the above-described manner, a grid voltage which provides a predetermined value of an image contrast, that is, the difference between the DC component of the developing bias and the surface potential $V_L$ after the light exposure, or $V_D - V_L$. The grid bias voltage source 4b is controlled in accordance therewith. In addition, in order to prevent toner deposition on the background of the image, that is, $V_D$ portion in this embodiment (reverse development), a developing bias $D_B$ which is lower than the surface potential $V_D$ by a predetermined amount ($V_B$), and the developing bias voltage source 1' is controlled in accordance therewith.

Figure 4A:
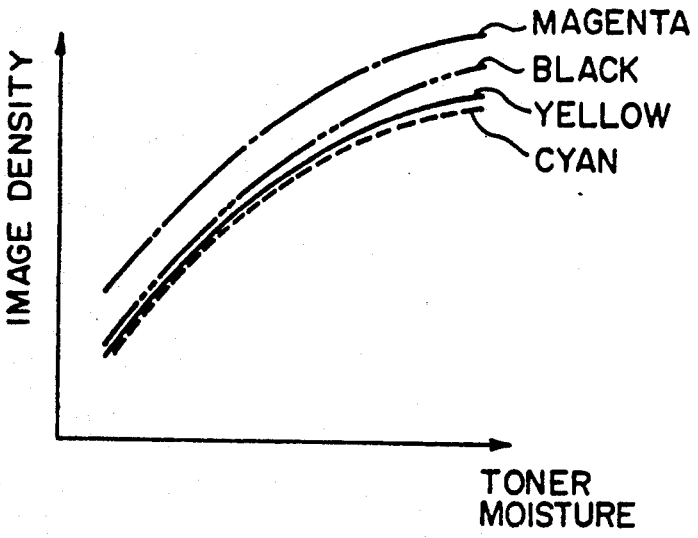
FIG. 4A is a graph of an image density vs. an amount of moisture absorption of the toner for each colors.
Figure 4B:
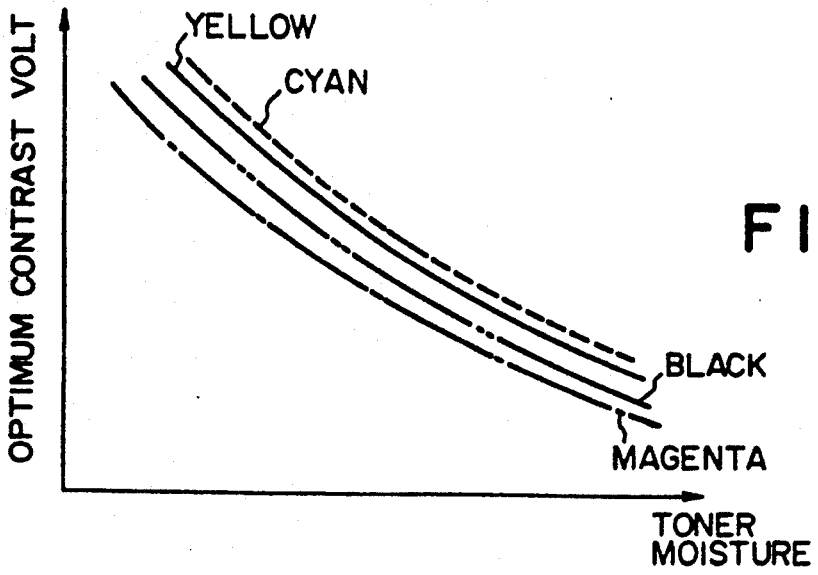
FIG. 4B is a graph of a set contrast potential vs. an amount of moisture absorption of the toner for each colors.

Here, the moisture absorption of the toner (amount of water absorbed by the toner) is defined as (weight of water)/(weight of toner), that is, weight percentage. FIG. 4A shows the relationship between the image density and the moisture absorption of the toner when the image is printed under the same image forming conditions. As shown in this Figure, the image density decreases with the decrease in the weight of the toner absorbed by moisture under the same image forming conditions, and the image density increases with increase of the toner moisture amount. In consideration of these, it is possible that a stabilized image forming condition substantially independent of variation in the ambient condition by determining a contrast voltage Vcont corresponding to the toner moisture absorption amount and by determining the image forming condition on the basis thereof. An optimum contrast voltage for providing the stabilized image for the moisture absorption of the toner, is shown in FIG. 4B. Since the relationship between the moisture absorption of the toner and the image density is different if the color is different, as shown in FIG. 4A, the image forming condition is preferably changeable for the respective colors as shown in FIG. 4B, whereby the difference in the image density depending on the difference in the color of the developer can be corrected.

As will be described below, the moisture absorption of the toner which is directly influential to the image density, is determined, and the image formation is possible with a proper image density despite variation in the ambience.

The description will be made as to the operation of the control means 18 in this embodiment, in conjunction with flow charts shown in FIGS. 5A, 5B and 5C. A process A shown in FIG. 5A predicts the current moisture absorption amount of the toner. Irrespective of the state of the main switch for supplying power to the apparatus, the ambience sensor 19 detects the temperature and humidity by interruption processing, once or more times for every 30 min., and an average is obtained. From the data, the determination is made to as the current moisture absorption.

Figure 6:
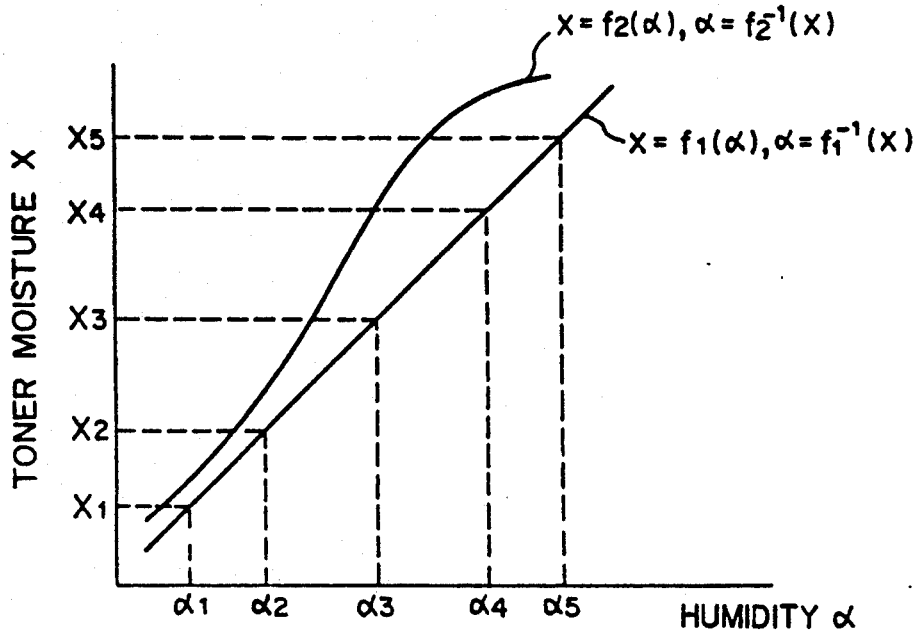
FIG. 6 is a graph of an amount of saturated moisture absorption of the toner vs. humidity.

As a general description, when a toner is placed under a condition of the humidity $\alpha$ for a sufficiently long period of time, the amount of moisture absorbed by the toner saturates at a predetermined level x. FIG. 6 shows a relationship between a humidity $\alpha$ and the saturated moisture content X of the toner, in the form of a function $x = f_1(\alpha)$ (or in the form of an inverse function $\alpha = f_1^{-1}(x)$). The amount of moisture absorbed by the toner to the saturation level under the humidity $\alpha_1 - \alpha_5$ is $x_1 - x_5$. If the color of the toner is different, or if the property of toner is different, the relationship between the humidity $\alpha$ and the moisture absorption amount x is different, for example, $x = f_2(\alpha)$.

Figure 7:
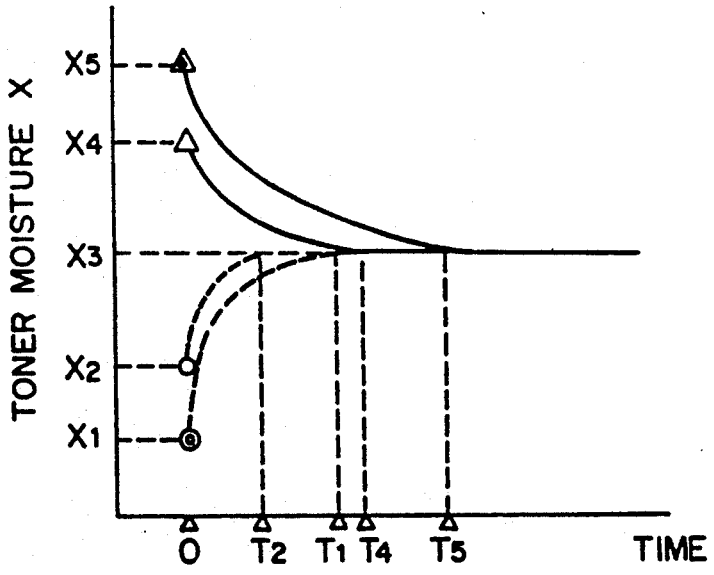
FIG. 7 is a graph of the toner moisture absorption vs. time upon sudden change of the humidity.

The time period required for the saturation is dependent upon the initial amount of the moisture absorbed by the toner and the subsequent influence of the change in the humidity (the degree of influence of the change in the humidity and the direction of the humidity change influence, that is, whether it increases or decreases the moisture content of the toner). FIG. 7 shows how the moisture absorption of the toner changes with time from the initial moisture absorption when the humidity changes. It is assumed that the toner having the initial moisture absorption (saturated) of $x_1$, $x_2$, $x_4$ or $x_5$, and that the humidity condition is changed to the humidity $\alpha_3$ at the time 0. The time period required for the absorption $x_1$, $x_2$, $x_4$ or $x_5$ reaches the saturated absorption at the humidity $\alpha_3$ is longer when the moisture is decreased than when the moisture is increased. If $|x_3-x_5|=|x_3-x_1|$, $|x_3-x_4|=|x_3-x_2|$ ($x_1<x_2<x_3<x_4$, $x_5$), the time periods T1, T2, T4 and T5 for $x_1$, $x_2$, $x_4$ and $x_5$ satisfy:

$$T2<T1<T4<T5$$

The time period required for the saturation and the amount of moisture absorption in the process of saturation is dependent on the property of the toner. Using the relation shown in FIG. 7, if the humidity $\alpha_3$ condition continues for not less than time period T5, it is determined that the moisture absorption of the toner is $x_3$ irrespective of the past moisture amount absorbed by the toner.

In this manner, the moisture absorption of the toner can be determined as a function of time, and therefore, the absorption can be properly detected even if the ambience abruptly changes. Therefore, proper image formation is possible.

The description will be made as to a method according to this embodiment for obtaining the current moisture absorption of the toner.

Figure 5A:
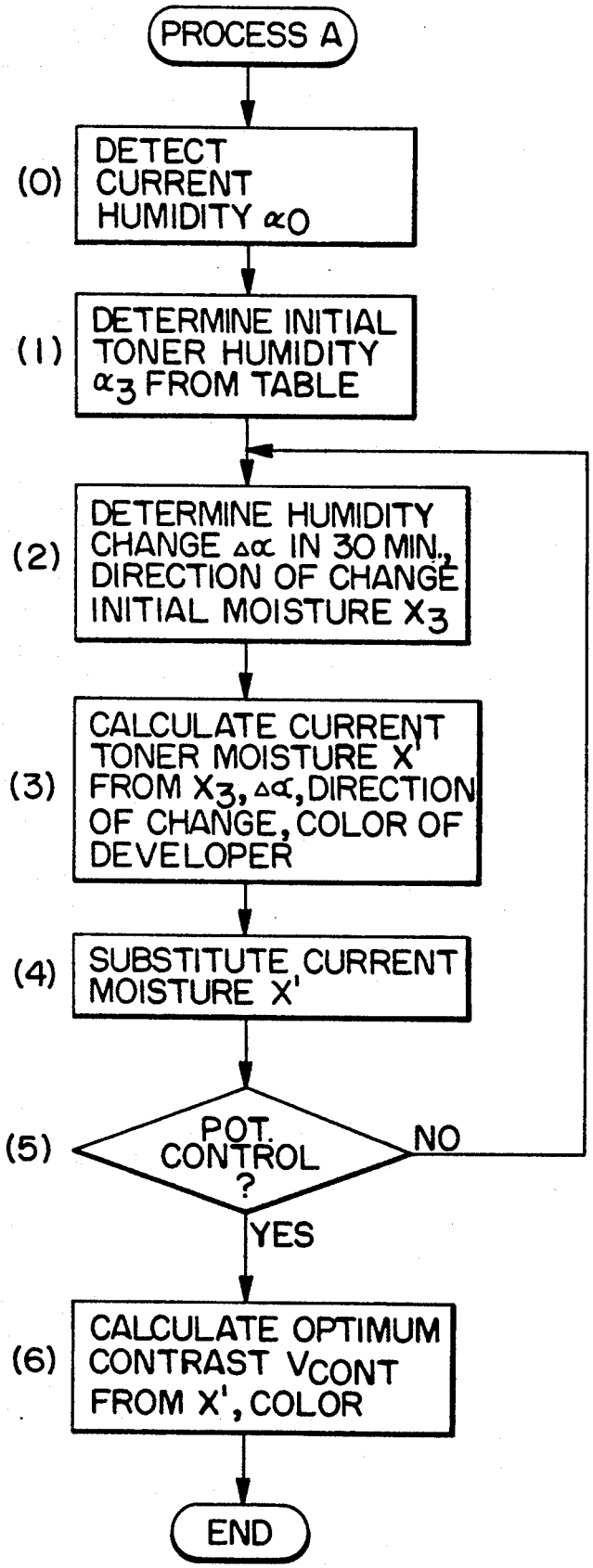
FIGS. 5A, 5B and 5C are flow charts for operations of setting the image forming conditions in the embodiment of the present invention.

As can be seen in FIG. 5A, the current humidity $\alpha_0$ is detected in step (0). In steps (1) and (2), the initial toner humidity $\alpha_3$, the change in humidity in 30 minutes $\Delta\alpha$ ($\alpha_0-\alpha_3$), the direction of the change and the initial toner moisture X3 is determined and used to determine the content of the moisture absorbed by the toner 30 min. after a certain point in time (step 3). For this determination, the relation $\alpha=f_1^{-1}(x)$ shown in FIG. 6, is used. More particularly, regarding the humidity change $\Delta\alpha(\alpha_0-\alpha_3)$, the measured current humidity is used, but the humidity at the time 30 minutes before the current detection of humidity is not a measured one. The humidity for calculating the humidity change is the one obtained inversely from the FIG. 6 relationship (step 1), as a plot corresponding to the moisture content of the toner at the certain point of time ($\alpha_3=f_1^{-1}(x_3)$).

Further particularly, i) Where the humidity is discriminated as having been increased, that is $\alpha_0 \geqq f_1^{-1}(x_3)$ ($=\alpha_3$):

$$x'=x_3\exp[(\alpha_0-\alpha_3)/k_1]$$

($k_1$: a constant proportional to a moisture absorption time constant of the toner)

ii) Where the moisture is discriminated as having been decreased, that is, $\alpha_0 \leqq f_1^{-1}(x_3)$ ($=\alpha_3$):

$$x'=x_3[1-\exp[(-\alpha_0-\alpha_3)/k_2]]$$

($k_2$: a constant proportional to a moisture dissipation time constant of the toner)

By substituting x with x' (x'=x), the moisture content of the toner after further 30 min. can be similarly determined (step 4). In this manner, the current moisture content or absorption x' can be obtained from the current humidity $\alpha_0$ and the moisture absorption x 30 min. before (without use of the measured humidity 30 min. before).

The equations for the calculation are obtained from the above equations given in (i) and (ii), as follows:

i) When $\alpha_0 \geqq f_1^{-1}(x)$ $$x'=x\exp[(\alpha_0-f_1^{-1}(x))/k_1]$$

($k_1$: a constant proportional to a moisture absorption time constant of the toner)

ii) When $\alpha_0 \leqq f_1^{-1}(x)$ $$x'=x[1-\exp-[(\alpha_0-f_1^{-1}(x))/k_2]]$$

($k_2$: a constant proportional to a moisture dissipation time constant)

By calculating sequentially the moisture absorption of the toner every 30 min., the current moisture content of the toner can be determined.

When the current moisture content of the toner is thus determined, the correct contrast voltage for providing the stabilized image can be determined on the basis of the relationship shown in FIG. 4B (steps 5 and 6).

In this manner, the image density can be properly determined from the two point data, namely the past data of the humidity and the moisture content at the time of 30 min. before and the current humidity. Therefore, the system can meet abrupt change of the ambience. In addition, it will suffice if only the previous data is stored, and therefore, the number of memory means for this purpose may be one.

Figure 5B:
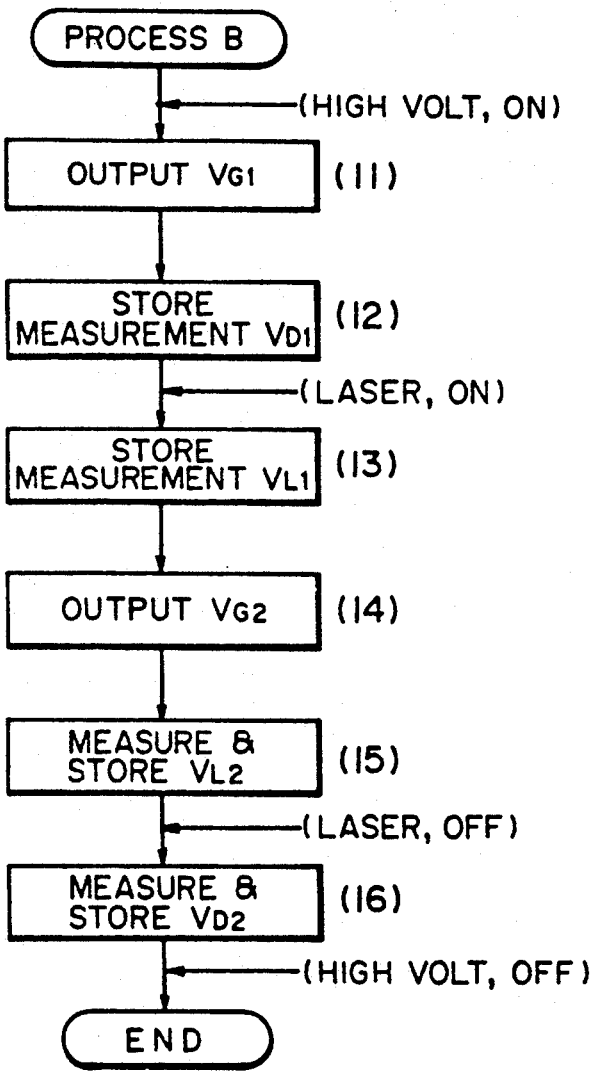

Referring to FIG. 5B, process B will be described. Similarly to an ordinary copying sequence, the photosensitive drum is rotated, and a primary high voltage source 4a is actuated. At steps 11 and 12, the grid bias is set to a predetermined level $V_{G1}$, and the surface potential of the photosensitive drum $V_{D1}$ is measured and stored in a memory. Next, the laser is actuated, and the drum is exposed to the maximum laser light intensity. At step 13, the surface potential $V_{L1}$ at the light portion after the exposure to the laser, and the surface potential is stored in a memory. Then, at steps 14 and 15, the grid bias is set to another predetermined level $V_{G2}$, and the surface potential $V_{L2}$ is measured. Thereafter, the laser is deactuated, and at step 16, the surface potential $V_{D2}$ is measured and is stored in a memory. In this manner, the data required for the calculation which will be described hereinafter is obtained. The order of actuation of the laser, the actuation thereof, measurements of dark and light potentials $V_{D1}$, $V_{D2}$, $V_{L1}$ and $V_{L2}$, and the setting of the grid bias voltages $V_{G1}$ and $V_{G2}$, may be changed for the convenience of the sequential operation. The process A and the process B are so independent that either can be performed first, and that they may not be contemporaneous.

Figure 5C:
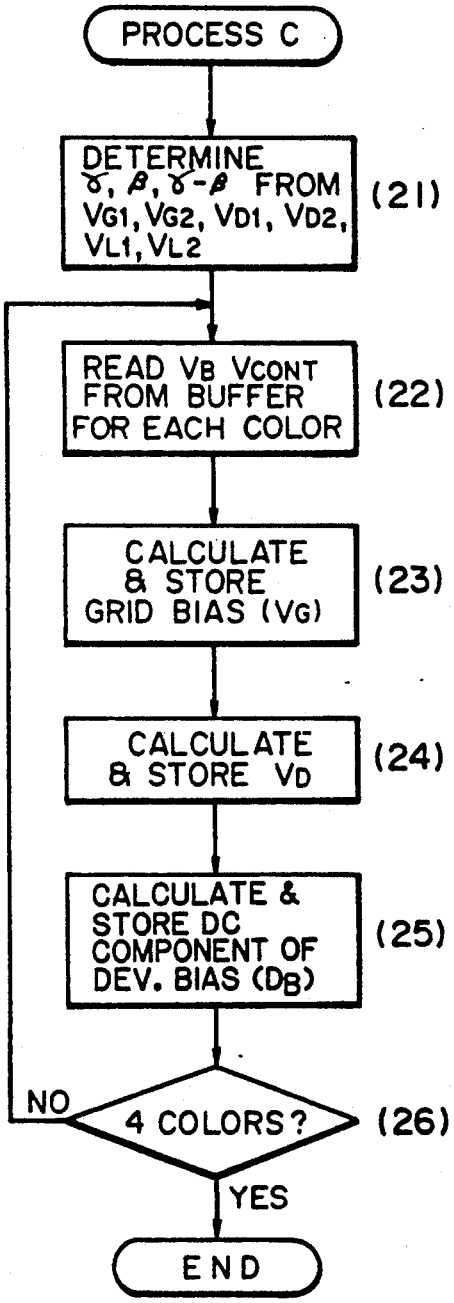

Referring to FIG. 5C, the description will be made as to process C. The process C has to be performed after the processes A and B are performed.

First, at step 21, inclinations $\gamma$ and $\beta$ and a difference $\gamma-\beta$ of charging curves for the dark and light potentials $V_D$ and $_L$ are calculated from $V_{G1}$, $V_{G2}$ and obtained data $V_{D1}$, $V_{D2}$, $V_{L1}$ and $V_{L2}$, by the following equation:

$$\gamma=(V_{D2}-V_{D1})/(V_{G2}-V_{G1})$$

$$\beta=(V_{L2}-V_{L1})/(V_{G2}-V_{G1})$$

Next, at step 22, the fog preventing voltage $V_B$ described hereinbefore and stored in the buffer area and the contrast voltage Vcont obtained by the process A are read out. At step 23, the grid bias voltage $V_G$ is determined so as to satisfy $V_D - V_L = Vcont + V_B$. In other words, the grid bias voltage $V_G$ is determined by the following equation:

$$V_G = [V_{cont} + V_B - (V_{D1} - V_{L1})]/(\gamma - \beta) + V_{G1}$$

When the grid voltage is determined at step 24, then $V_D$ is determined by the following equation:

$$V_D = \gamma(V_G - V_{G1}) + V_{D1}$$

Then, at step , a DC component (DB) of the developing bias is obtained by the following equation:

$$DB = V_D - V_B$$

At step 25, when the above process has been completed for each of the four colors, the processing is terminated.

Thus, the controlled grid bias $V_G$ and the controlled developing bias DB are obtained.

The grid bias voltage $V_G$ and the developing bias DB determined in the manner described above take into account not only the humidity conditions under which the developer has been placed but also the respective properties of the different color developers. Therefore, very stabilized good image densities can be provided.

In the foregoing embodiment, the ambience detecting means detects the humidity, but another or other factors influential to the toner other than the humidity, such as absolute moisture amount and temperature may be measured, and they are used for the image density control.

In the foregoing embodiment, the image forming condition or conditions are determined on the basis of the charged potential of the photosensitive drum, a potential after exposure of the photosensitive drum to light and the developing bias potential, but another or other conditions may be controlled, such as charged potential of the developer and ratio of the toner in the developer, that is, a toner/carrier ratio.

The foregoing embodiments have been described as to a multi-color image forming apparatus, but the present invention is not limited to this, and it is applicable to a usual monochromatic image forming apparatus.

As regards the setting of the moisture content of the toner in the control system, at the initial point, that is, at the time of the apparatus installation, the serviceman can do it, repeating test runs for reaching the proper image. It should be noted that even if the initial setting of the moisture content of the toner, the value detected by the system according to the present invention automatically approaches the correct value with each occurrences of substantially long (a few hours, for example) state of constant humidity condition, because of the nature of the detection system according to the present invention.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

image forming means for forming an image on said image bearing member, said image forming means including developing means for developing with a developer a latent image formed on said image bearing member;

detecting means for detecting an ambient condition at predetermined intervals;

means for determining a state of current moisture absorption of the developer on the basis of a current ambient condition at a current time, past state of moisture absorption of the developer at one of the predetermined intervals before the current time and an ambient condition determined on the basis of the past state of moisture absorption; and means for controlling said image forming means in accordance with the current state of moisture absorption of the developer determined by said determining means.

2. An apparatus according to claim 1, wherein said detecting means detects humidity in said apparatus.

3. An apparatus according to claim 1, wherein said determining means operates at the same intervals as said detecting means.

4. An apparatus according to claim 1, wherein said determining means includes a first table storing a relation between a saturated state of moisture absorption and the ambient condition.

5. An apparatus according to claim 4, when said developing means develops with plural developers, and wherein the first table is different for each of the developers.

6. An apparatus according to claim 1, wherein said determining means includes means for discriminating whether the developer is in the process of absorbing the moisture, whether it is in the process of dissipating the moisture or whether it is under a balanced condition.

7. An apparatus according to claim 1, wherein said determining means includes a second table storing a revelation between the state of moisture absorption of the developer and time.

8. An apparatus according to claim 7, wherein said developing means develops with plural developers, and wherein said second table is different for each of the developers.

9. An apparatus according to claim 1, wherein said control means includes a third table storing a relation between the state of moisture absorption of the developer and a contrast potential of said image bearing member.

10. An apparatus according to claim 9, wherein said developing means develops with plural developers, and wherein said third table is different for each of the developers.

11. An apparatus according to claim 1, wherein said image forming means includes charging means for charging said image bearing member, and wherein said control means controls charging power of said charging means.

12. An apparatus according to claim 1, wherein said control means controls a developing bias of said developing means.

13. An apparatus according to claim 11, wherein said charging means includes a grid electrode, and wherein said control means controls a voltage applied to the grid electrode.

14. An apparatus according to claim 1, wherein said developing means contains different color developers, and wherein said control means controls said image forming means in accordance with the colors of the developers.

15. An apparatus according to claim 1, wherein said control means controls a toner carrier ratio of the developing means.

16. An image forming apparatus, comprising:

an image bearing member;

image forming means for forming an image on said image bearing member, said image forming means includes developing means for developing with a developer a latent image formed on said image bearing member;

detecting means for detecting an ambient condition;

means for determining a state of moisture absorption of the developer;

storing means for storing only a latent datum of state of moisture absorption of the developer determined by said determining means; and control means for controlling said image forming means in accordance with the state of moisture of absorption stored in said storing means.

17. An apparatus according to claim 16, wherein only one of said storing means is provided.

18. An apparatus according to claim 16, wherein said control means includes a table storing a relation between the state of moisture absorption of the developer and a contrast potential of said image bearing member.

19. An apparatus according to claim 18, wherein said developing means develops with plural developers, and wherein the table is different for each of the developers.

20. An apparatus according to claim 16, wherein said image forming means includes charging means for charging said image bearing member, and wherein said control means controls charging power of said charging means.

21. An apparatus according to claim 16, wherein said control means controls a developing bias of said developing means.

22. An apparatus according to claim 20, wherein said charging means includes a grid electrode, and wherein said control means controls a voltage applied to the grid electrode.

23. An apparatus according to claim 16, wherein said developing means contains different color developers, and wherein said control means controls said image forming means in accordance with the colors of the developers.

24. An apparatus according to claim 16, wherein said control means controls a toner carrier ratio of the developing means.

25. An image forming apparatus, comprising:

an image bearing member;

image forming means for forming an image on said image bearing member, said image forming means including developing means for developing with a developer a latent image formed on said image bearing member;

detecting means for detecting an ambient condition;

means for determining a state of moisture absorption of the developer;

a table storing a relation between state of moisture absorption of the developer and time; and control means for controlling said image forming means in accordance with the state of moisture absorption of the developer determined in accordance with said table.

26. An apparatus according to claim 25, wherein said developing means with plural developers, and wherein said table is different for each of the developers.

27. An apparatus according to claim 25, wherein said control means includes a second table storing a relation between the state of moisture absorption of the developer and a contrast potential of said image bearing member.

28. An apparatus according to claim 27, wherein said developing means develops with plural developers, and wherein said second table is different for each of the developers.

29. An apparatus according to claim 25, wherein said image forming means includes charging means for charging said image bearing member, and wherein said control means controls charging power of said charging means.

30. An apparatus according to claim 25, wherein said control means controls a developing bias of said developing means.

31. An apparatus according to claim 29, wherein said charging means includes a grid electrode, and wherein said control means controls a voltage applied to the grid electrode.

32. An apparatus according to claim 25, wherein said developing means contains different color developers, and wherein said control means controls said image forming means in accordance with the colors of the developers.

33. An apparatus according to claim 25, wherein said control means controls a toner carrier ratio of the developing means.

* * * * *

UNITED STATES PATENT AND TRADEMARK OFFICE
CERTIFICATE OF CORRECTION

PATENT NO. : 5,225,872

DATED : July 6, 1993

INVENTOR(S) : FUKUSHIMA

It is certified that error appears in the above-identified patent and that said Letters Patent is hereby corrected as shown below:

On the title page,

AT [57] ABSTRACT

Line 10, "past" should read --a past--.
Line 11, "the" (second occurrence) should read --a--.

Column 1

Line 59, "pre-" should be deleted.
Line 60, "dicted" should be deleted.
Line 67, "an" should read --a--.

Column 2

Line 13, "cross sectional" should read --cross-sectional--.
Line 18, "colors." should read --color.--
Line 21, "colors." should read --color.--
Line 36, "an" should read --a--.
Line 39, "device" should read --device 2--.

Column 3

Line 11, "to" should read --for--.
Line 14, "is" should read --are--.
Line 54, "$V_L$" ($\alpha$>B)." should read --$V_L$($\gamma$>B).--
Line 60, "represents" should read --represent--.

UNITED STATES PATENT AND TRADEMARK OFFICE

CERTIFICATE OF CORRECTION

PATENT NO. : 5,225,872

DATED : July 6, 1993

INVENTOR(S) : FUKUSHIMA

It is certified that error appears in the above-identified patent and that said Letters Patent is hereby corrected as shown below:

Column 4

Line 16, "absorbed by" should read --by absorbed--.
Line 35, "toner" should read --toner,--.
Line 55, "X" should read --x--.

Column 5

Line 37, "X3" should read --$x_3$--.

Column 7

Line 16, "step," should read --step 25,--.
Line 56 "currences" should read --currence--.

Column 8

Line 11, "past" should read --a past--.
Line 29, "when" should read --wherein--.
Line 40, "revelation" should read --relation--.

Column 9

Line 5, "toner carrier" should read --toner/carrier--.
Line 12, "includes" should read --including--.
Line 18, "latent" should read --latest-- and "state" should read --the state--.

UNITED STATES PATENT AND TRADEMARK OFFICE

CERTIFICATE OF CORRECTION

PATENT NO. : 5,225,872

DATED : July 6, 1993

INVENTOR(S) : FUKUSHIMA

It is certified that error appears in the above-identified patent and that said Letters Patent is hereby corrected as shown below:

Column 10

Line 2, "toner carrier" should read --toner/carrier--.
Line 21, "means with" should read --means develops with--.
Line 50, "toner carrier" should read --toner/carrier--.

Signed and Sealed this

Fourteenth Day of June, 1994

Bruce Lehman

*Attest:*

BRUCE LEHMAN

*Attesting Officer*

*Commissioner of Patents and Trademarks*